US008083441B2

(12) United States Patent
Garcia

(10) Patent No.: US 8,083,441 B2
(45) Date of Patent: Dec. 27, 2011

(54) HERMETIC LOAD DISTRIBUTOR MAT

(76) Inventor: Bruno Antonio Caracchini Garcia, Lima (PE)

( * ) Notice: Subject to any disclaimer, the term of this patent is extended or adjusted under 35 U.S.C. 154(b) by 1 day.

(21) Appl. No.: 12/725,610

(22) Filed: Mar. 17, 2010

(65) Prior Publication Data

US 2010/0239376 A1 Sep. 23, 2010

(30) Foreign Application Priority Data

Mar. 18, 2009 (PE) ..... 403-2009/DIN

(51) Int. Cl.
*E02D 17/20* (2006.01)
*E02D 17/00* (2006.01)

(52) U.S. Cl. ..... 405/302.7; 405/302.4; 405/302.6

(58) Field of Classification Search ..... 405/304.4, 405/304.5, 304.6, 304.7; 404/34, 41
See application file for complete search history.

(56) References Cited

U.S. PATENT DOCUMENTS

| | | | | |
|---|---|---|---|---|
| 2,922,344 | A * | 1/1960 | Meissner | 404/35 |
| 4,647,258 | A * | 3/1987 | Massarsch | 405/302.5 |
| 5,536,111 | A * | 7/1996 | Doernemann | 405/16 |
| 2005/0271852 | A1 * | 12/2005 | Solomon et al. | 428/58 |

* cited by examiner

*Primary Examiner* — David Bagnell
*Assistant Examiner* — Kyle Armstrong
(74) *Attorney, Agent, or Firm* — Galbreath Law Offices, P.C.; John A. Galbreath

(57) ABSTRACT

A hermetic load distributor mat is disclosed, for sealing soils that are unstable or have low bearing capacity, and for optimally distributing loads over such soil. The mats connect together to form a stable, hemetically-sealed floor. The joints between the mats have a flexible seal. The mats are assembled together empty, and then are filled with a fluid such as water, the weight of which stabilizes and stiffens the mat and favorably distributes external loads.

2 Claims, 8 Drawing Sheets

Figure 1 - Prior art

Figure 6
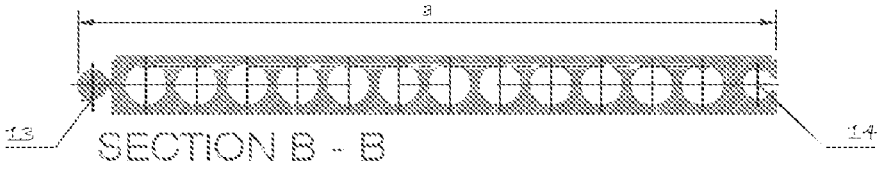
Figure 5
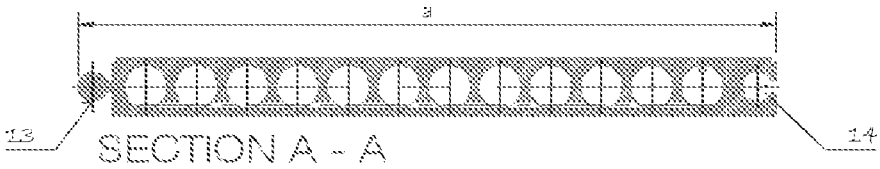
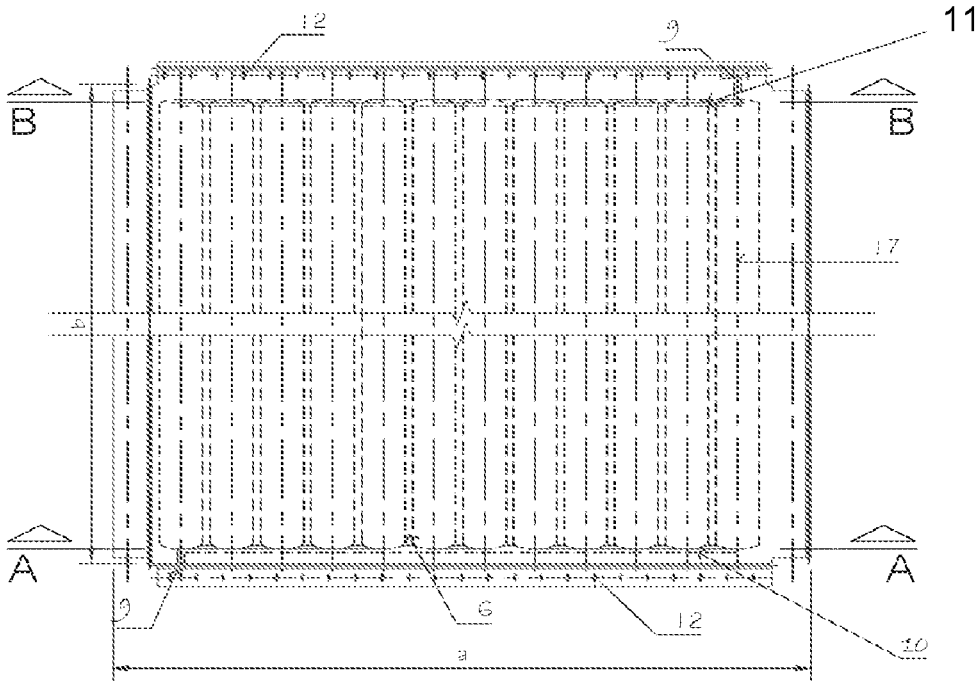
Figure 4

Figure 9
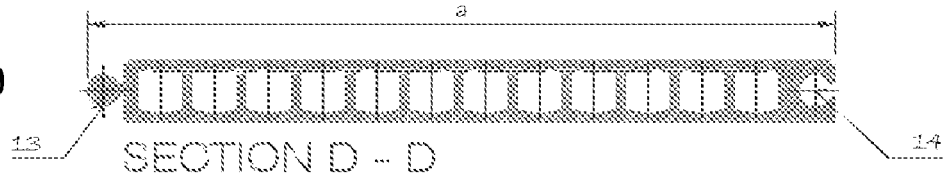
Figure 8
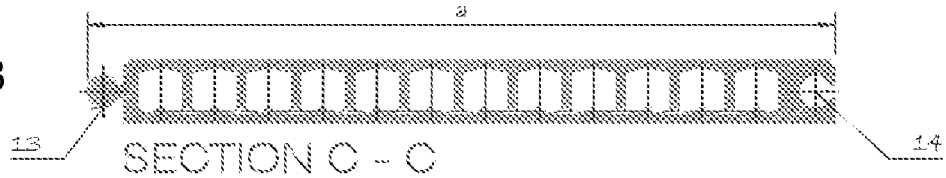
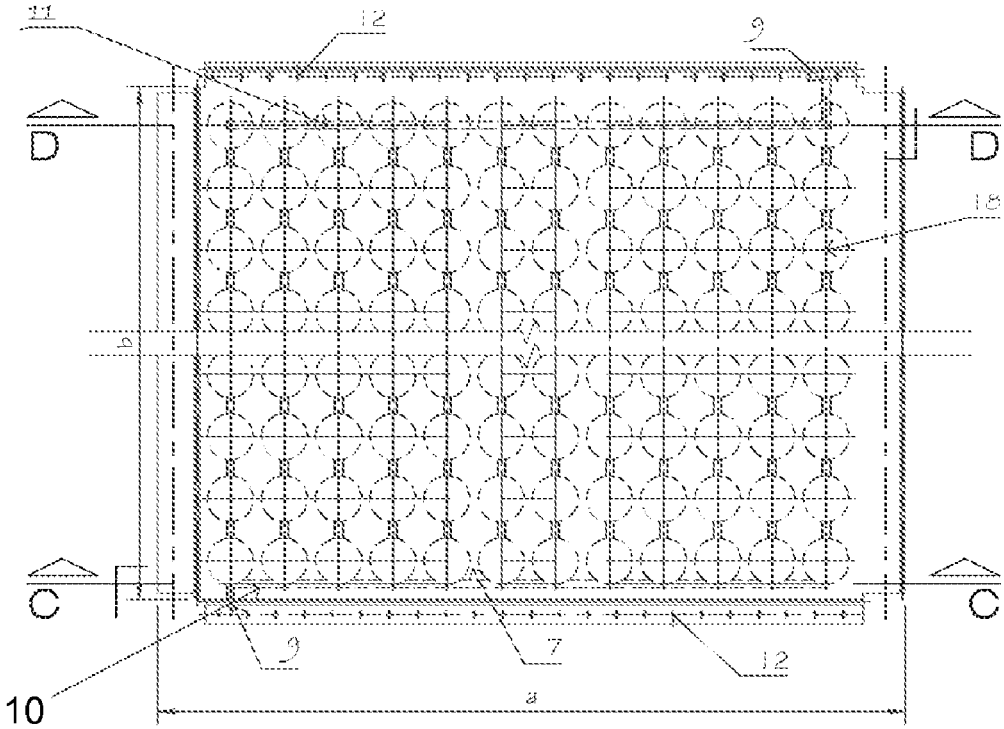
Figure 7

HERMETIC LOAD DISTRIBUTOR MAT

FIELD OF THE INVENTION

The invention falls within the field of construction, and more specifically in the field of covering ground which is natural or prepared with earthmoving machinery, when the ground has characteristics of low bearing capacity or instability, for the purpose of developing temporary and/or permanent activities of construction and operation of facilities, equipment and processing plants and others.

DESCRIPTION OF THE RELATED ART

Currently, and especially in rainforest areas because the ground is unstable due to clay type volumetric changes and loss of consistency under the effect of the rains, there is a need to cover the ground with waterproofing and rigid elements adequate to provide appropriate pressure distribution in the soil and prevent contact with rainwater. In addition, there is a need to prevent contaminants from buildings and operations from entering the ground.

For these purposes, the current technique involves the installation of the following systems:

- A geomembrane installed directly on the ground to obtain waterproofness.
- Planks of wood, floor units or plastic racks or resin reinforced with glass fiber, commonly known as mats and crating respectively. They are placed directly on the geomembrane, and assembled together. Their function is to spread the external loads on the ground, so that reaction bulb pressures do not exceed the carrying capacity of the ground.

The current technique, while allowing for waterproofness and load (pressure) distribution in the field, has the following disadvantages:

- High transport costs due to the weight and volume of the elements involved (geomembrane, wood, mats or crating, installation equipment and personnel). This is especially important in helicopter transport operations.
- Long periods of installation and removal of the elements involved. The lengthy process and technical requirements of assembling the geomembrane installation, wood, mats or crating, and vice versa disassembling them, result in increased costs of personnel, equipment and machinery.
- Ecological problems when using wood, as required volumes of wood are high, and this is therefore a factor in the degradation of forests.

Therefore an efficient solution should have the following characteristics:

- Low weight/volume.
- Easy installation.
- Avoid using wood.

The proposed invention is an efficient response to the problems noted, and as discussed below, the invention resolves these problems one by one.

DETAILED DESCRIPTION OF THE INVENTION

The present invention relates to a new type of floor for load distribution and sealing of soils that are unstable or have low bearing capacity. Basically, the idea is to convert the solid elements which are traditionally a floor unit for these applications, in pressure vessels in order to gain the following advantages:

- During transport, the inner spaces are empty, thereby minimizing weight.
- The installation is done with empty inner spaces, which allows for easy handling. Each unit (mat) offers sliding systems for rapid interconnection between the units.
- Once installed, the unit (mat) is filled with a fluid, usually water, so that externally, its weight stabilizes it on the soil and, internally, enables the creation of pressures that very favorably distribute external load. This design allows low weight, while stiffening the floor so as to allow transmission of the load over an extended area.

Additionally it meets the following characteristics:

- The installation process ends with the rapid assembly of flexible joint seals on the periphery of each unit (mat) that is interconnected. This gives the floor the hermetizing property of isolating the land from rain and pollution. This avoids the problems of delays and costs related to the use of geomembranes.
- The items are manufactured in thermoplastic with or without reinforcing fibers, or in resins reinforced with glass fiber, thus avoiding the use of wood and making possible the use of recycled material. Additionally, the design will allow a long service life (multiple cycles of assembly and disassembly).

Figure 1:
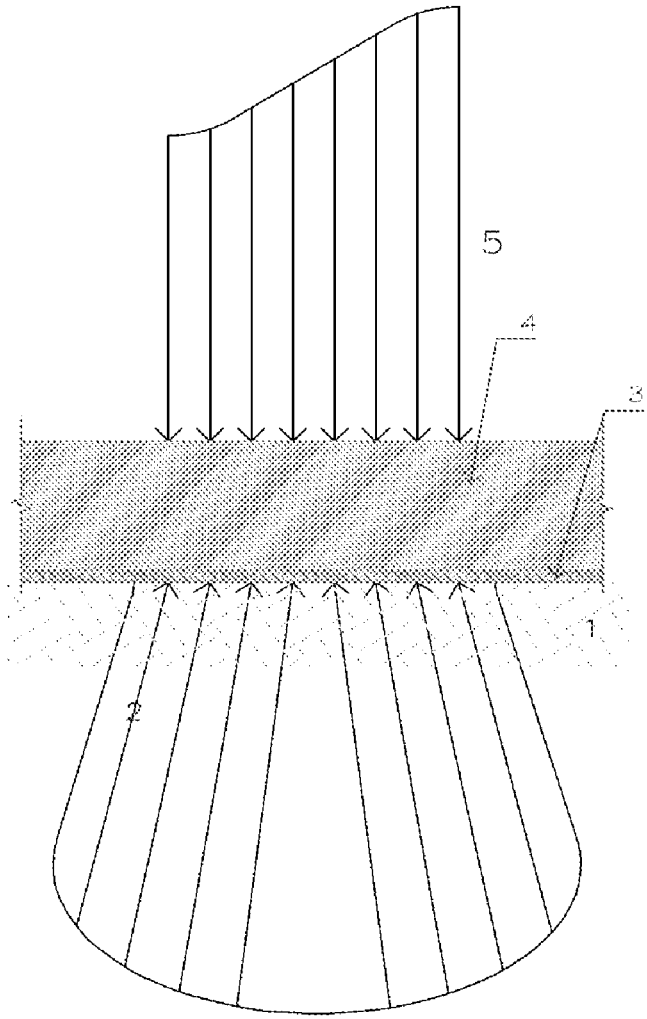
FIG. 1 shows a conventional prior art mat having the following features.

- Geomembrane (3) installed directly on the ground (1) for waterproofing.
- Wooden boards, floors or plastic racks or resin reinforced with fiberglass (4), commonly known as mats and crating respectively. They are placed directly on the geomembrane (3). Their function is to spread the external load (5) in soil (1) creating a reaction bulb pressure (2) not exceeding the carrying capacity of the soil.

Figure 2:
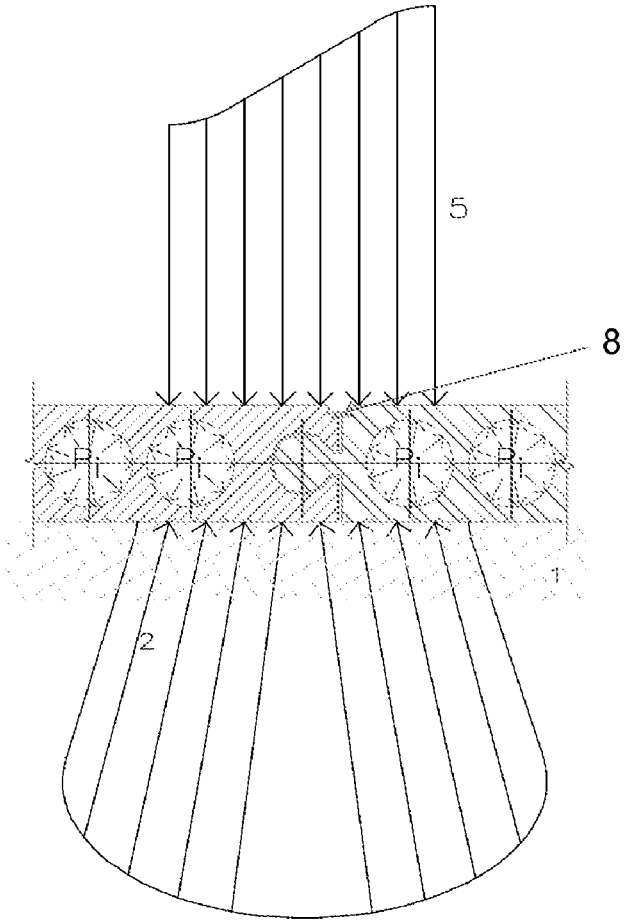

FIG. 2 shows one of the configurations proposed, consisting of two assembled floor mats of horizontal tubular type. As shown in FIG. 2, and also in FIGS. 4-6 described below, the horizontal tubular elements are oriented parallel to the plane of the top surface of the mat. The external load (5) is transferred to the soil (1) creating a reaction bulb pressure (2) not exceeding the carrying capacity of the soil. Internally, $P_i$ creates pressure that balances the external load (5) and stiffens all.

FIG. 2 also shows the flexible seal (8) to seal the assembly of the two floor units (mats).

Figure 3:
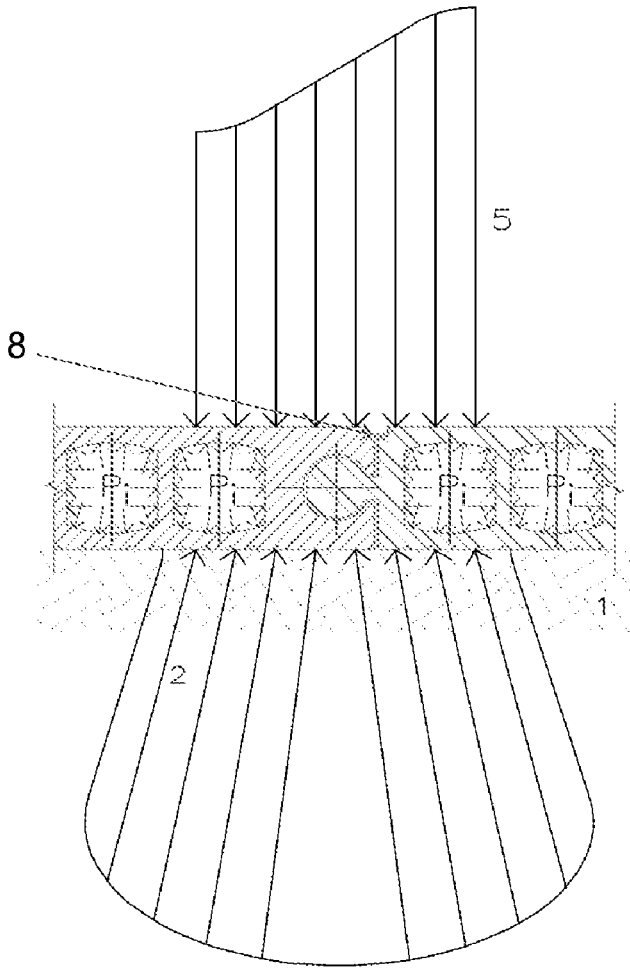

FIG. 3 shows another proposed configuration consisting of two assembled floor mats of vertical tubular type. As shown in FIG. 3, and also in FIGS. 7-9 described below, the vertical tubular elements are oriented perpendicular to the plane of the top surface of the mat. The effects on soil and internal distribution of pressure are functionally the same as for the configuration shown in FIG. 2.

FIG. 3 also shows the flexible seal (8) to seal the assembly of the two floor mats.

FIGS. 4-9 show further details of the mats of FIGS. 2 and 3, and also how they can be connected together to form a floor.

The mat shown in FIG. 4 has a body composed of horizontal tubular elements (6).

FIGS. 5 and 6 are cross-sectional views of the mat shown in FIG. 4, with the sections being taken along section lines A-A and B-B respectively. The fill fluid is fed via the input manifold (10) which is detailed in Section AA, and the air in the tubular elements is blown by the manifold (11) located at the top of the section to ensure complete filling with fluid for the correct conversion of the external load into internal pressure without major deformations of the outer walls of the mat (detailed in Section BB). For the same reason, the water intake manifold (10) is located at the bottom of the section, which ensures air sweeping over the entrance of the fluid. After filling and venting, the filling connections are closed with caps (9).

For connecting the floor mats together, the mat shown in FIG. 4 is provided on the right side with a circular section groove (14), into which the cylindrical protrusion (13) from the left side of the unit (mat) shown in FIG. 7 is slidably inserted. The left side of the mat shown in FIG. 4 has the reverse situation—it has a cylindrical protrusion (13) for connecting to the circular section groove of another mat.

Figure 12:
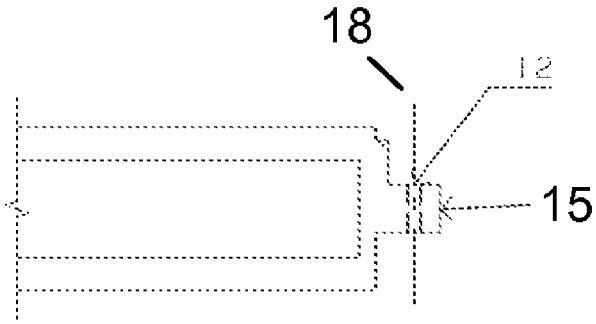
Figure 13:
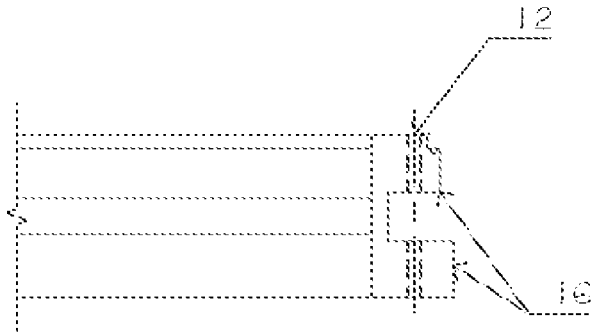
Figure 14:
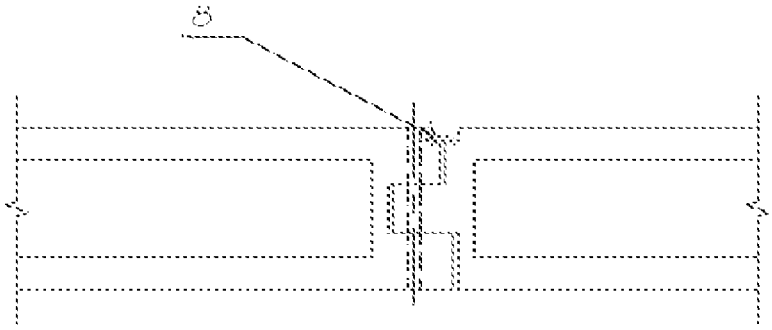

For connecting the upper and lower sides together, the mat has a box (16) and tang (15) system, as detailed in FIGS. 12-14.

The mat shown in FIG. 7 has a body made up of vertical tubular elements (7); however, the other features are similar to those of the mat shown in FIG. 4.

FIGS. 8 and 9 are cross-sectional views of the mat shown in FIG. 7, with the sections being taken along section lines C-C and D-D respectively.

Figure 10:
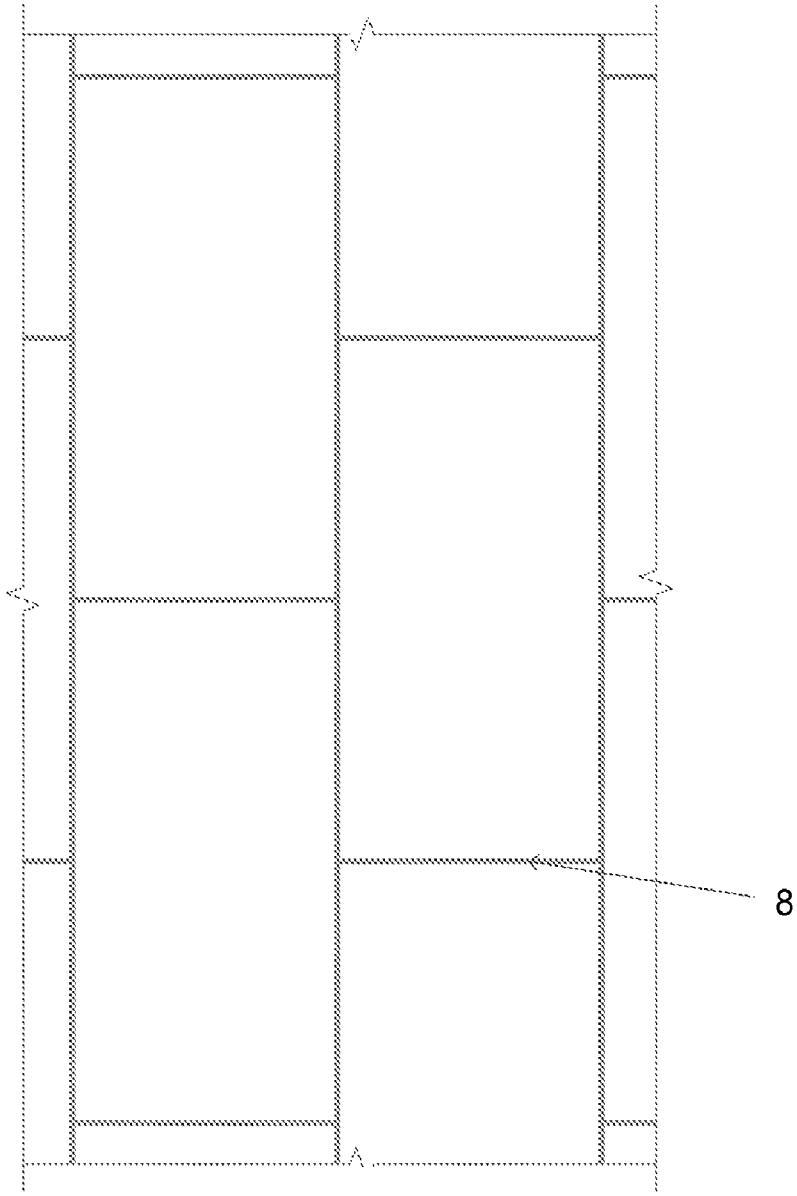

FIG. 10 shows the arrangement of the mats; that is, the assembled floor mats on the ground and the location of flexible sealing gasket (8) at the periphery of each mat.

Figure 11:
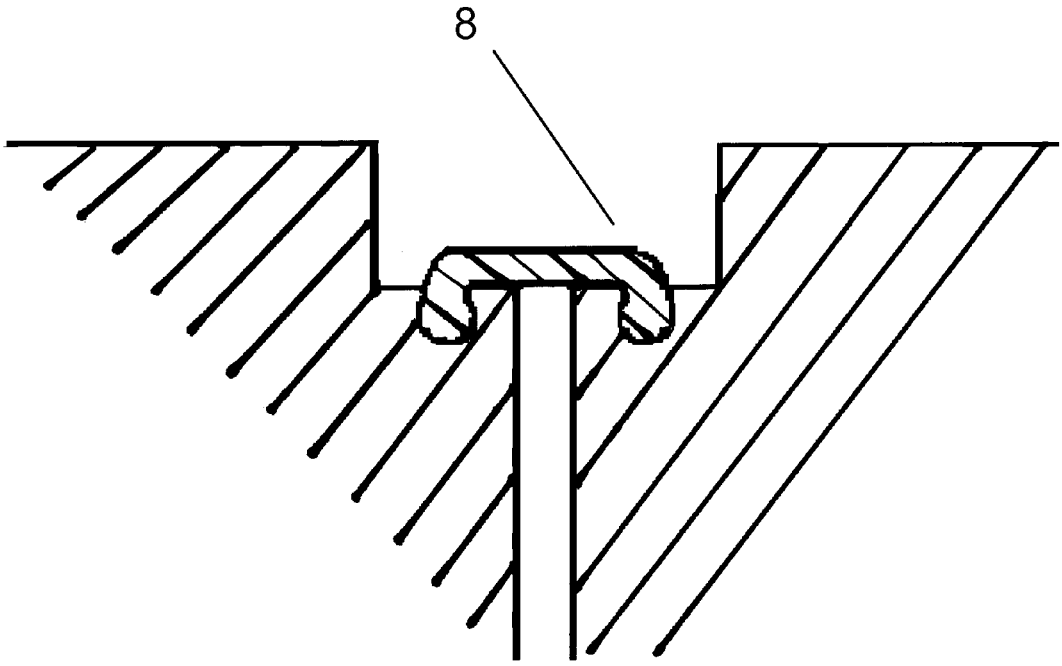

FIG. 11 shows the detail of the seal between the mats—that is, the assembly of flexible sealing element (8) in the channels cut into the periphery of each mat (17).

FIGS. 12-14 show the detail of the box (16) and tang (15) assembly mechanism used between the mats. The holes (12) receive safe pins (18) that secure the mats together once the tang (15) is slipped into the box (16).

EXAMPLES OF PERFORMING THE INVENTION

The present invention is additionally illustrated by the following example, which is not intended to limit its scope:

Example

Platforms for Oil Drilling Rigs in the Jungle

Situations where there are heavy rains, the soil consists of clay, costs are high for transportation and maintenance of personnel and equipment, and there are environmental requirements required by the PAMA (Environmental Handling Adequacy Program) for each project, are ideal conditions for the implementation of the invention.

The material that the mats are made of must be able to withstand high mechanical loads, and the material which will be exposed also must be resistant to environmental conditions (humidity and high solar radiation). Flexible joint seals must be resistant to environmental conditions and oil spills. The invention uses high density polyethylene (HDPE) for all elements of the mat and oil-resistant elastomers for the flexible joint seal. Both materials will be stable when exposed to ultraviolet radiation (UV). The fill fluid is water, which is readily available.

The invention claimed is:

1. A load distributor mat for loading and sealing of soils, comprising:

parallel tubular elements (6) or perpendicular tubular elements (7), oriented parallel or perpendicular, respectively, to the plane of the top surface of said load distributor mat;

an entry manifold (10) and a vent manifold (11) each having sealing plugs (9);

an interconnection assembly comprising a circular section groove (14), a cylindrical protrusion (13), and a box (16) and (15) system provided with through holes (12) and safe pins (18) located in the through holes (12);

said load distributor mat also having peripheral slots (17) and flexible sealing gaskets (8) located in the peripheral slots (17), and wherein the parallel tubular elements (6) or the perpendicular tubular elements (7) can be filled with a fluid through the entry manifold (10) and the same vented, if required, through the vent manifold (11), the fluid being retained within the parallel tubular elements (6) or the perpendicular tubular elements (7) by the sealing plugs (9).

2. The load distributor mat of claim 1, wherein the flexible sealing gaskets (8) are made of flexible plastic material resistant to weathering and chemical attack from oil and other substances that are present during construction and operation of facilities.

* * * * *